US006513295B2

(12) United States Patent
Bernardino

(10) Patent No.: US 6,513,295 B2
(45) Date of Patent: Feb. 4, 2003

(54) SUSPENSION SYSTEM FOR FALSE CEILING PANELS

(75) Inventor: Bertella Bernardino, Marostica (IT)

(73) Assignee: Sadi S.p.A., Altavilla Vicentina (IT)

( * ) Notice: Subject to any disclaimer, the term of this patent is extended or adjusted under 35 U.S.C. 154(b) by 0 days.

(21) Appl. No.: 09/880,172

(22) Filed: Jun. 13, 2001

(65) Prior Publication Data

US 2001/0052212 A1 Dec. 20, 2001

(30) Foreign Application Priority Data

Jun. 20, 2000 (IT) ..... MI00A1388

(51) Int. Cl.[7] ..... E04B 9/02; E04B 1/74
(52) U.S. Cl. ..... 52/506.09; 52/407.4; 52/506.08
(58) Field of Search ..... 52/506.07, 506.08, 52/506.09, 404.1, 407.1, 407.3, 407.4

(56) References Cited

U.S. PATENT DOCUMENTS 1,937,843 A * 12/1933 Randall ..... 52/506.09
2,009,512 A * 7/1935 Offutt et al. ..... 52/506.09
3,324,967 A 6/1967 Robinson
3,444,800 A 5/1969 Nelsson
4,272,928 A 6/1981 Schlüter
4,545,165 A * 10/1985 Carey et al. ..... 52/506.07
4,901,485 A 2/1990 Menchetti et al.
5,311,719 A * 5/1994 Jahn ..... 52/506.09
5,732,521 A 3/1998 Schmitt-Raiser

* cited by examiner

*Primary Examiner*—Michael Safavi
(74) *Attorney, Agent, or Firm*—Hedman & Costigan, P.C.

(57) ABSTRACT

A suspension system for false ceiling panels easy to install and remove. The suspension system exhibits a high resistance to fire and low heat transmission following a fire, according to safety regulations currently in force for naval and civil furniture. The system comprises a reticular structure suspended to the floor, consisting of upturned-T structural members to which suitable tie rods fastened to the floor are coupled. The structural members being arranged with primary and secondary members orthogonally arranged with respect to one another forming bays within which ceiling panels are positioned. A series of metal panels are inserted snap-wise in the bays obtained in the reticular suspension structure. The snap wise insertion is effected by step-wise edges along each edge of the metal panels. Insulation material is inserted along a back side of the panels to provide the high resistance to fire and low heat transmission following a fire.

11 Claims, 4 Drawing Sheets

SUSPENSION SYSTEM FOR FALSE CEILING PANELS

The present invention relates to a suspension system for false ceiling panels.

Usually, civil or naval false ceilings (for cabin areas) that, according to the relevant regulations in force, must exhibit a high resistance to fire (class B15 according to the regulations in force), are built with self-bearing staves that jointed to the walls through variable-section structural members fastened to the same walls.

Staves are then laid or fastened through screws on such structural members.

In this case, since such staves develop in length rather than in width, the appearance of the entire false ceiling panelling is always the same, since only the presence of spacing or not between the staves, or different surface finishing, such as colour, can be changed.

At this point, it is certainly possible to realise any type of ceiling under the above stave ceiling; however, in this case, the total false ceiling thickness would be consistent and thus, it would result in a considerable loss of useful space, besides being difficult to install and remove.

On the other hand, the realisation of a square false ceiling would solve the problem of creating new aesthetical shapes; however, normal panel false ceilings in their standard 600× 600 mm size or in other sizes, also at rectangular geometry, do not exhibit high fire resistance features, as required by the regulations relating to naval cabins.

Thus, purpose of the present invention is that of indicating a suspension system for false ceiling panels, which should allow realising a panel ceiling of various sizes, easy to install and remove, which should at the same time exhibit a high fire resistance.

Another purpose of the invention is that of realising a suspension system for false ceiling panels, which should exhibit a low heat transmission following the possible propagation of a fire, according to what reported in the current civil and naval safety regulations.

A further purpose of the invention is that of realising a suspension system for false ceiling panels, which could be applied to an existing ceiling also by not particularly skilled or expert personnel.

Another possibility of the false ceiling according to the invention is that of using suitable slots obtained on the panel edges to allow the passage or conditioned air (either delivered or recycle air).

Last but not least, another purpose of the present invention is that of realising a suspension system for false ceiling panels, which should substantially be low-priced, simple, safe and reliable.

These and other purposes according to the present invention, are achieved by realising a suspension system for false ceiling panels according to claim 1, to which reference shall be made for shortness.

Advantageously, the present invention discloses a panel ceiling realisable in various sizes, square or rectangular-shaped, easy to install and remove, and exhibiting at the same time a high fire resistance. Moreover, the system for fastening the panels to the support structure does not use any system structural component, such as screws or springs, besides the plate forming the panel.

Finally, after installation, each panel is supported by a reticular structure and exhibits an appearance similar to that of contiguous panels; moreover, it can be fastened both horizontally and vertically, and thus it does not allow clearly seeing how it can be removed from the entire false ceiling structure; it is resistant and tends to stay in its original position even in case of destructive events, such as fires or earthquakes.

The panel is also easy to remove from the ceiling by carrying out the reverse operations performed for its installation; no specific tools are needed for installation or removal.

Further features and advantages of a suspension system for false ceiling panels, according to the present invention, will appear more clearly from the following exemplificative and non-limiting description made with reference to the attached schematic drawings. In such drawings.

Figure 1:
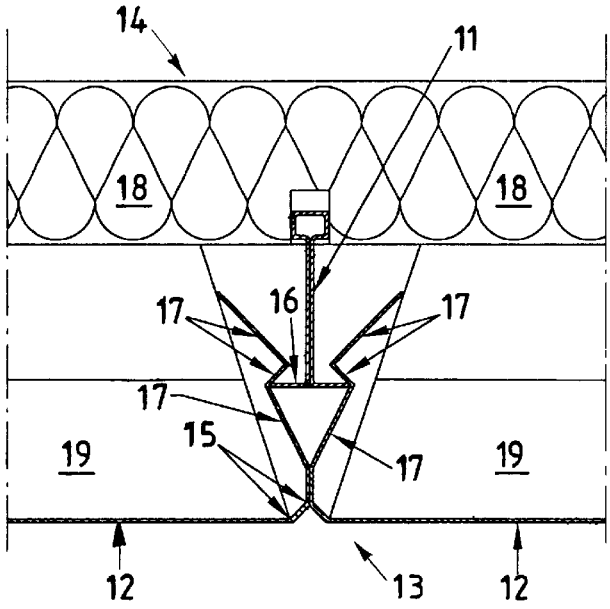
FIG. 1 shows a transversal and partial section of a suspension system for false ceiling panels according to the present invention.
Figure 5:
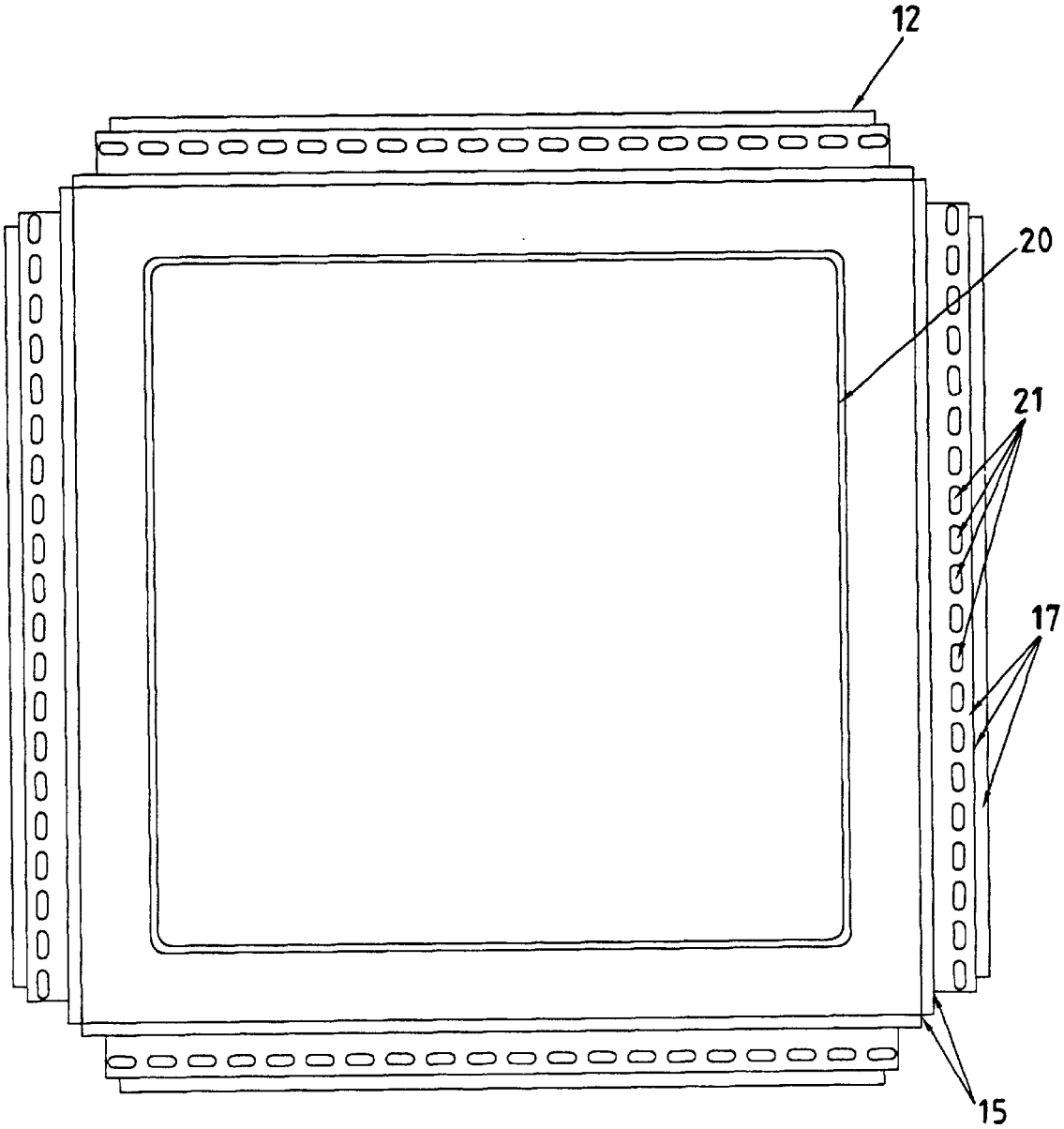
FIG. 5 shows a plan view of the panel development, with slits for air passage, before being shaped.

With reference to the above figures, it should be noted that the suspension system for false ceiling panels, according to the invention, comprises a suspension structure and a panelling, intended as coating structure consisting of various panels, each indicated with reference numeral 12 in FIG. 1 and shown in detail, according to one of the proposed embodiments, in FIG. 5.

The suspension structure comprises a series of structural members, indicated with reference numeral 11 in the figures, which are made of galvanised steel plate, and they are shaped as upturned U, with a painted sheet steel coating on the horizontal portion 16 of the T. Such structural members 11 are divided into members called "primary", having a multiple length with respect to the false ceiling module, with ends suitably prepared for their sliding coupling, and with suitable intermediate slots for the coupling with other members, called "secondary", and having the same length as the false ceiling module, which are orthogonally arranged with respect to the primary members.

The resulting reticule, in se known, is suspended to the floor through suitable tie rods, that are coupled to the primary structural members of the structure; moreover, in this way, a series of bays is determined in the structure reticule, which form the frames usable for the step-wise insertion of each metal panel 12 inside them. Panel 12 is made of galvanised sheet steel, having a thickness equal to about 0.5–0.6 mm, and it is shaped at its edges so as to take advantage of the material elasticity, thus allowing its step-wise introduction into the reticular structure.

As clearly shown in the attached drawings, besides allowing an easy installation and removal, through a special suction cup, the particular shaping of edges 17 of each panel 12 guarantees an excellent stability with respect to deformations caused by high temperatures, preventing them from falling, and preventing the passage of fire from a front portion 13 of panel 12 to a back portion 14.

Actually, as it can be noted in detail in FIG. 1, edges 17 of each panel 12 exhibit a broken line shaping with grooves 15 and squared portions; since edges 17 of panel 12 are made of a thin and light metal material, it is very easy to install panels 12 step-wise, sided to one another, so that when the squared portions slightly bend inwards into panel 12 upon insertion, they cause the seal of the T-shaped structural member 11 on the horizontal member 16.

An insulating material, laid at the upper portion of panel 12, consists of two mats 18, 19, having different thickness and density, made of rock wool and suitably shaped at the edges to close in an optimum manner possible cracks between panels 12, which may form due to deformations of panel 12 if subject to fire.

The final result is that of obtaining, at the back side 14 of panel 12, a continuous surface of insulating material which, in case of fire, allows maintaining the temperature below limit values as provided by the relevant regulations in force.

In particular, according to preferred and exemplificative but non-limiting embodiments of the invention, experimental results show that, at a temperature of about 800–850 centigrade degrees that may develop in case of fire, on the lower portion 13 of panel 12, it is possible to obtain a drastic reduction of the temperature value at its upper portion, within the limits provided by the regulations in force.

Figure 6:
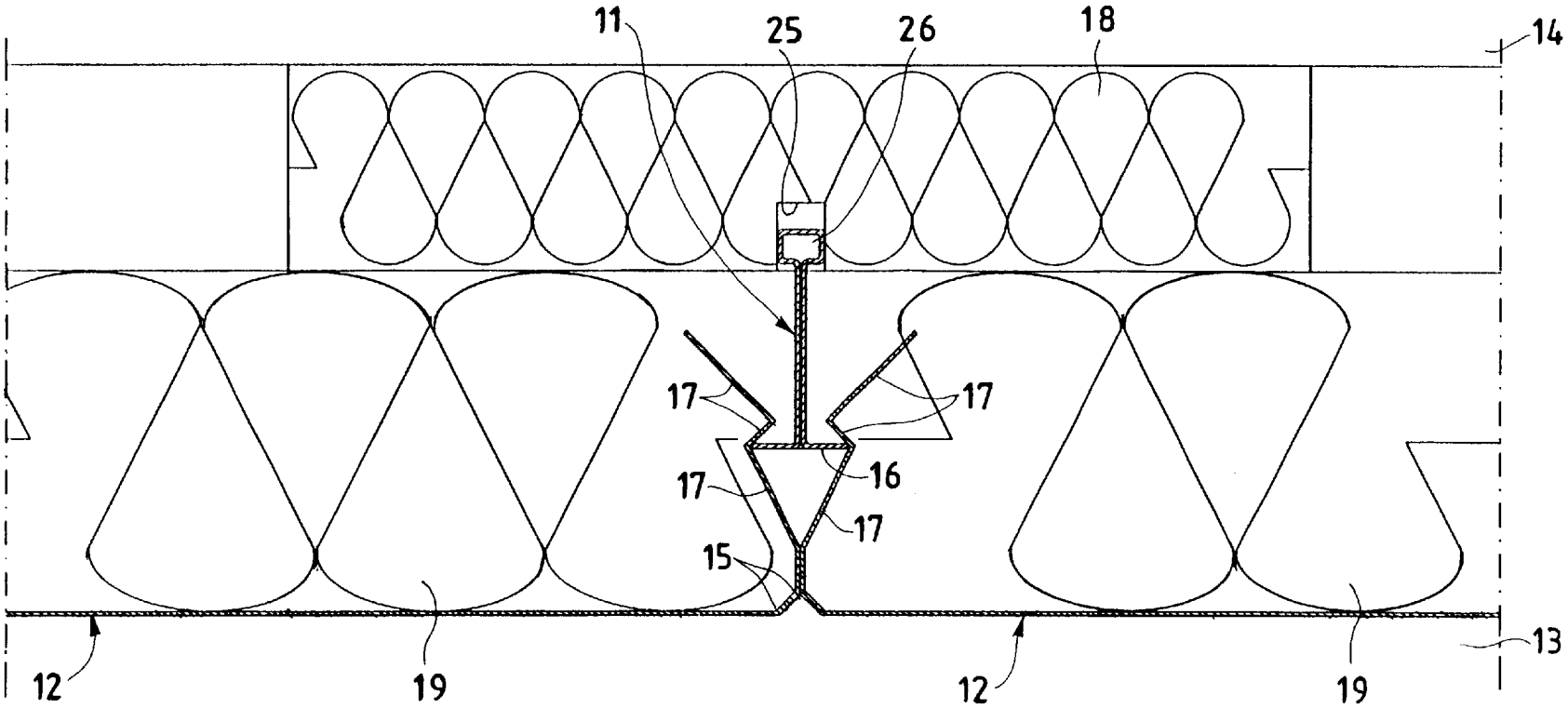
FIG. 6 shows a transversal and partial section of a suspension system for false ceiling panels, according to the present invention, and its embodiment is an alternative to that of FIG. 1.

In a preferred but non-limiting embodiment of the present invention, illustrated by way of an example in FIG. 6, mats 18 are not sided at the level of the vertical axis of the T of the structural member 11 (as in FIG. 1) but rather, a single mat 18 shaped as a cap is used for each row of structural members 11 of the reticule, and their central recess 25 is arranged at member 26 of the structural member 11.

The use of metal panels 12 having the particular geometry of edges 17 mentioned above, thus allows their simple and correct installation and removal, without using any additional component, such as fastening screws or springs, besides the plate forming panel 12; moreover, since the support material of panels 12 consists of galvanised steel plate, the aesthetical finishing of the type indicated with reference numeral 20 in FIG. 5 can be of several types, compatibly with the required fire resistance features, and they can relate to simple painting, inserted decorations, sized materials, drilled portions, or else.

Finally, the use of mats 18, 19, made of insulating material as described above, also allows obtaining considerable sound deadening through a suitable selection of specific densities; such feature is important for the primary use for which such false ceiling is intended.

Figure 2:
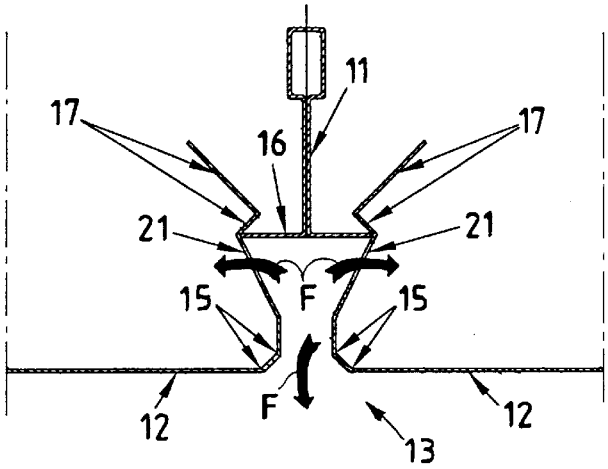
FIGS. 2 and 3 show schematic transversal and partial sections of two first embodiments of a suspension system for false ceiling panels, according to the present invention.
Figure 3:
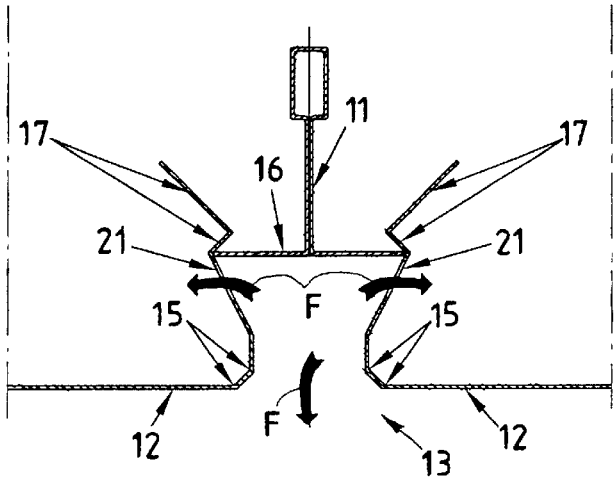

According to the embodiments shown in FIGS. 2 and 3, which respectively refer to suspension structures comprising structural members 11 having different sizes, it is further provided to create openings, indicated with reference numeral 21, on at least one of the squared portions of edge 17.

Such openings 21 allow realising a spray distribution system of the air or a recycle system of the same air (arrows F); in this case, panels 12 are installed without introducing mats 18, 19 laid on the back side. A plan view of panel 12 having shaped portions 17 wherein there are provided openings 21 for air passage is represented in FIG. 5; moreover, such view refers to the plan view of panel 12 with slits 21 for air passage, before being shaped.

Figure 4:
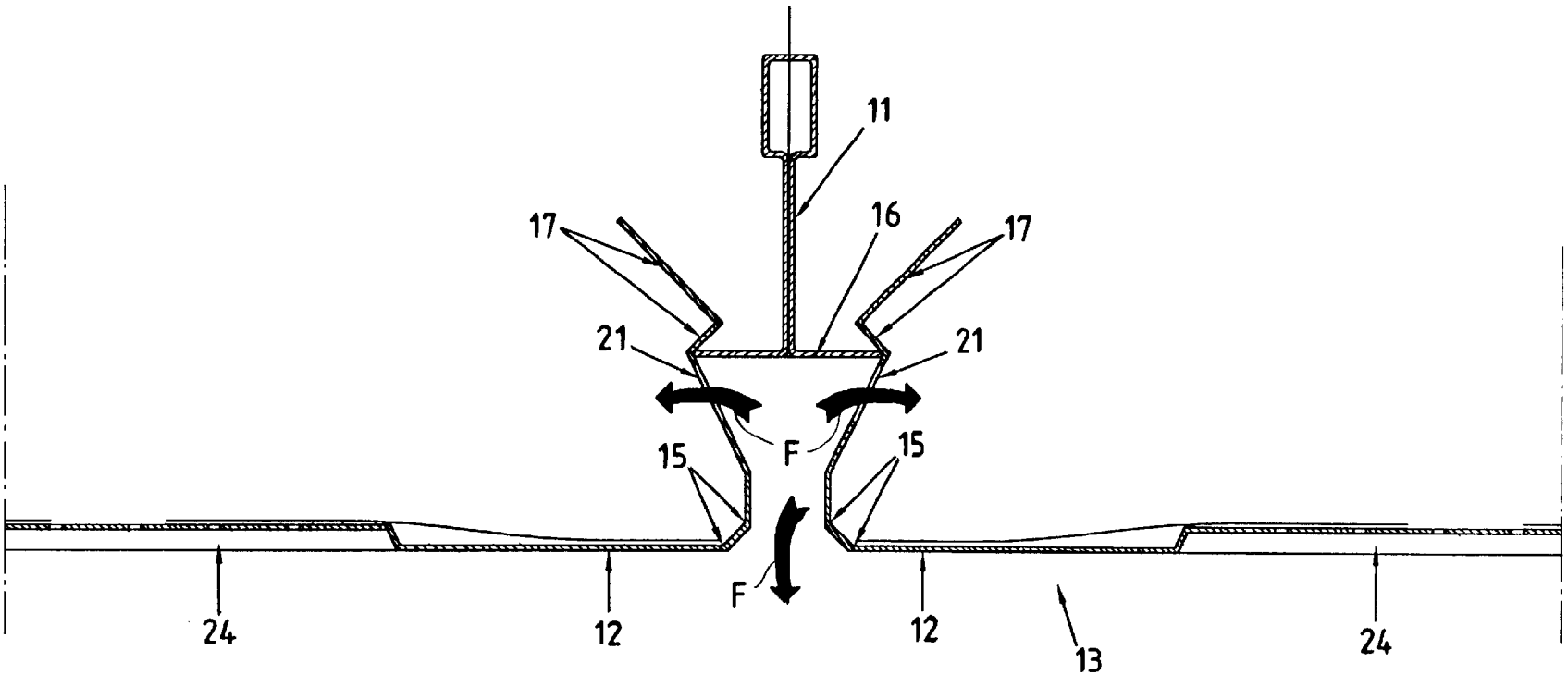
FIG. 4 shows a further transversal section of a second embodiment of a suspension system for false ceiling panels, according to the invention.

Finally, FIG. 4 refers to a same suspension structure, wherein the shaped portions 17 exhibit openings 21 and each panel 12 is provided with at least one drilled portion 24 for decorative and/or deadening purposes with the application of special deadening material.

The features of the suspension system for false ceiling panels, object of the present invention, as well as its advantages, clearly appear from the above description. It is clear that several variants can be made to the suspension system object of the invention, without departing from the novelty principles of the inventive idea.

It is also clear that, in the practical embodiment of the invention, materials, shapes and sizes of the illustrated details can be of any type according to requirements, and the same can be replaced with other technically equivalent details.

What is claimed is:

1. Suspension system for false ceiling panels (12), comprising a reticular structure, a plurality of ceiling panels having step-wise edges, and at least one layer of an insulating material, said reticular structure consisting of a plurality of upturned-T structural members (11), characterized in that said structural members (11) are divided into primary members, and secondary structural members orthogonally arranged with respect to said primary members, said reticular structure being suspended to a floor through tie rods coupled to said structural members (11) so as to obtain a series of bays into the structure, each forming a frame usable for the step-wise insertion of said panel (12), characterized in that said panel (12) is shaped at each edge (17) according to a broken line outline, so that at least two portions of such line allow a simplified installation and removal of the panel (12) and determine a step-wise fit seal of said panel (12) on said structure.

2. Suspension system according to claim 1, characterised in that said structural members (11) are made of galvanised steel plate with a painted sheet steel coating on a horizontal portion (16) of the T.

3. Suspension system according to claim 1, characterised in that said panel (12) exhibits finishing (20) relating to painting, inserted decorations, sized materials, or drilled portions.

4. Suspension system according to claim 1, characterised in that said panel (12) is made of galvanised sheet steel shaped at the edges (17) so that the elasticity of the material allows its step-wise insertion into the reticular structure and guarantees stability, in case of fire, with respect to deformations caused by high temperatures, preventing them from falling, and preventing the passage of fire from a front portion (13) to a back portion (14) of said panel (12).

5. Suspension system according to claim 1, characterised in that said edges (17) of said panel (12) comprise grooves (15) and squared portions, and are made of a thin and light metal material so that, upon the step-wise insertion into the reticular structure, when said squared portions slightly bend inwards into the panel (12), they cause the seal on said structural member (11).

6. Suspension system according to claim 4, characterized in that said insulating material comprises at least one layer inserted on the back side of said ceiling panel (12), said insulating material layer consisting of at least one mat (18).

7. Suspension system according to claim 6, characterized in that said mat (18) is shaped as a cap, wherein at least one central recess (25) is arranged at an upper member (26) of said structural member (11), said mat (18) being made of rock wool and shaped so as to obtain, at the back side (14) of said ceiling panel (12), a continuous surface of insulating material which, in case of fire, allows maintaining a temperature below that temperature on a front side (13) of said ceiling panel (12).

8. Suspension system according to claim 6, characterised in that at least two mats (18, 19) having different thickness and density are provided.

9. Suspension system according to claim 6, characterized in that said insulating material comprises at least two mats (18, 19) and provide for sound deadening.

10. Suspension system according to claim 4, characterised in that said panel (12) is provided with at least one drilled portion (24) for decorative and deadening purposes.

11. Suspension system according to claim 5, characterized in that at least one of said squared portions of the edge (17) of each panel (12) is provided with at least one aeration opening (21) for the passage of air (F) and when said structural members (11) have different sizes, creates an opening between said ceiling panels (12) for the passage of air (F).

* * * * *

UNITED STATES PATENT AND TRADEMARK OFFICE

CERTIFICATE OF CORRECTION

PATENT NO. : 6,513,295 B2
DATED : February 4, 2003
INVENTOR(S) : Bernardino Bertella It is certified that error appears in the above-identified patent and that said Letters Patent is hereby corrected as shown below:

Title page,
Item [12] should read -- Bertella --
Item [75], Inventor, should read -- Bernardino Bertella --

Signed and Sealed this

Eighth Day of June, 2004

JON W. DUDAS
*Acting Director of the United States Patent and Trademark Office*